US011603623B2

(12) United States Patent
MacDonald, III

(10) Patent No.: US 11,603,623 B2
(45) Date of Patent: Mar. 14, 2023

(54) LINT FILTER LATCH

(71) Applicant: Haier US Appliance Solutions, Inc., Wilmington, DE (US)

(72) Inventor: Robert V. MacDonald, III, Simpsonville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 182 days.

(21) Appl. No.: 17/205,737

(22) Filed: Mar. 18, 2021

(65) Prior Publication Data

US 2022/0298717 A1 Sep. 22, 2022

(51) Int. Cl.
*D06F 58/22* (2006.01)

(52) U.S. Cl.
CPC ..... *D06F 58/22* (2013.01)

(58) Field of Classification Search
CPC ..... D06F 58/22; F26B 21/003; F26B 25/007; B01D 46/0005
See application file for complete search history.

(56) References Cited

U.S. PATENT DOCUMENTS

| | | | | |
|---|---|---|---|---|
| 10,047,475 B2 | 8/2018 | Lee | | |
| 2015/0247279 A1 * | 9/2015 | Bison | ..... | D06F 58/22 34/82 |

FOREIGN PATENT DOCUMENTS

| | | | | |
|---|---|---|---|---|
| CA | 2798779 A1 * | 11/2011 | ..... | B01D 35/30 |
| CN | 211972843 U | 11/2020 | | |
| EP | 2407588 A1 * | 1/2012 | ..... | D06F 58/22 |
| EP | 2407588 B1 | 12/2013 | | |
| EP | 3031977 A1 * | 6/2016 | ..... | D06F 58/02 |
| GB | 2091123 A * | 7/1982 | ..... | D06F 58/22 |
| WO | WO2019096305 A1 | 5/2019 | | |
| WO | WO-2020087659 A1 * | 5/2020 | ..... | D06F 58/22 |

* cited by examiner

*Primary Examiner* — Jessica Yuen
(74) *Attorney, Agent, or Firm* — Dority & Manning, P.A.

(57) ABSTRACT

A lint filter includes a first housing and a second housing pivotally connected to the first housing, the first housing including a first latch having a first hook and a second latch having a second hook, the second housing defining a handle groove and including a first protrusion and a second protrusion, the first latch corresponding to the first protrusion and the second latch corresponding to the second protrusion such that when the lint filter is in a closed position, the first latch is latched to the first protrusion and the second latch is latched to the second protrusion.

18 Claims, 5 Drawing Sheets

LINT FILTER LATCH

FIELD OF THE INVENTION

The present subject matter relates generally to lint filters, and more particularly to latching mechanisms for lint filter frames.

BACKGROUND OF THE INVENTION

Laundry treatment appliances (e.g., washers, dryers, combination washer/dryers, etc.) generally perform one or more operations on articles to be washed. For instance, a tub holding treated articles is rotated within the appliance to perform a washing operation or a drying operation. Particularly during the drying operation, air is circulated through the tub via a fan to remove moisture from the treated articles. During the circulation, the air may pick up foreign items such a lint. The foreign items may get caught in the fan, causing damage to the fan and potential damage to the treated articles.

These laundry treatment apparatuses typically include lint filters for filtering out the foreign items from the air, particularly during a drying operation. The lint filters may be mesh screens attached to plastic housings or casings. In some cases, the housing may be opened and closed to clean out the captured foreign items. However, conventional housings or casings have simple latching mechanisms that are easily broken during normal opening and closing.

Accordingly, a lint filter that obviates one or more of the above-mentioned drawbacks would be beneficial. In particular, a lint filter having an improved latching mechanism would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a lint filter is provided. The lint filter may include a first housing defining an inner face and an opposite outer face, the inner and outer faces of the first housing extending between a hinged end and a free end, the first housing comprising a handle defining a first latch and a second latch each extending inward from the inner face, the first latch being disposed at a first lateral end of the handle, the second latch being disposed at a second lateral end of the handle; a second housing defining an inner face and an opposite outer face, the inner and outer faces of the second housing extending between a hinged end and a free end, the hinged end of the second housing being pivotally connected to the hinged end of the first housing, the second housing defining a handle groove having a lateral interior defined between a first groove end and a second groove end; a first protrusion disposed within the handle groove, the first protrusion extending laterally from the first groove end toward the lateral interior of the handle groove; and a second protrusion provided within the handle groove, the second protrusion extending laterally from the second groove end toward the lateral interior of the handle groove.

In another exemplary aspect of the present disclosure, a lint filter is provided. The lint filter may include a first housing defining an inner face and an opposite outer face, the inner and outer faces of the first housing extending between a hinged end and a free end, the first housing comprising a first center strut extending between the hinged end and the free end, a first cross strut intersecting with the first center strut and extending between a first side and a second side of the first housing, and a handle defining a first latch and a second latch each extending inward from the inner face, the first latch being disposed at a first lateral end of the handle, the second latch being disposed at a second lateral end of the handle; a second housing defining an inner face and an opposite outer face, the inner and outer faces of the second housing extending between a hinged end and a free end, the hinged end of the second housing being pivotally connected to the hinged end of the first housing, the second housing defining a handle groove having a lateral interior defined between a first groove end and a second groove end, the second housing comprising a second center strut extending between the hinged end and the free end, and a second cross strut intersecting with the second center strut and extending between a first side and a second side of the second housing; a first protrusion disposed within the handle groove, the first protrusion extending laterally from the first groove end toward the lateral interior of the handle groove; and a second protrusion provided within the handle groove, the second protrusion extending laterally from the second groove end toward the lateral interior of the handle groove.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
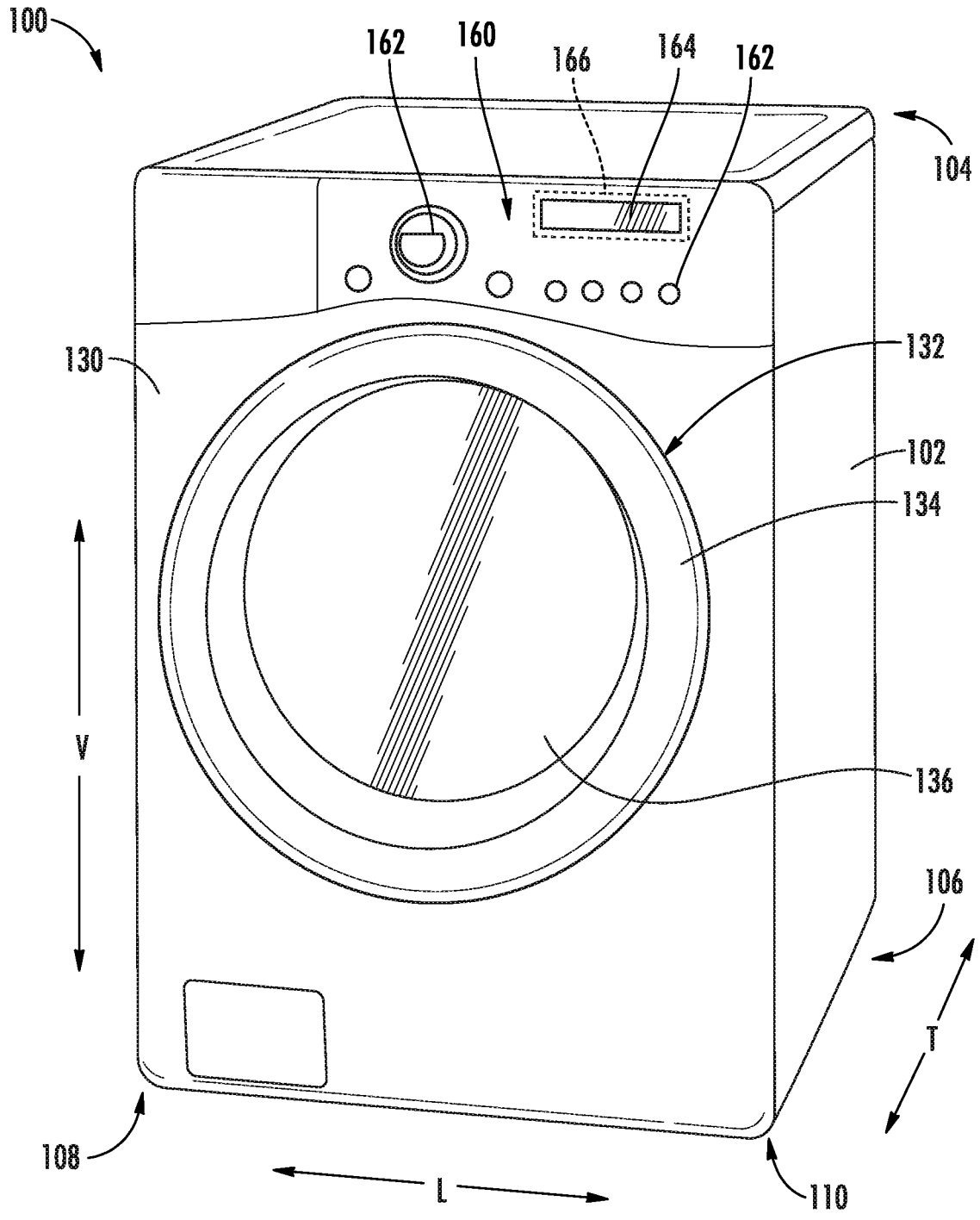
FIG. 1 provides a perspective view of a dryer appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "first," "second," and "third" may be used interchangeably to distinguish one element from another and are not intended to signify location or importance of the individual elements. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Referring now to the figures, FIG. 1 is a perspective view of an exemplary front-load dryer appliance 100 (e.g., combination washer-dryer appliance). As illustrated, dryer appliance 100 generally defines a vertical direction V, a lateral direction L, and a transverse direction T, each of which is mutually perpendicular, such that an orthogonal coordinate system is defined. Dryer appliance 100 includes a cabinet 102 that extends between a top 104 and a bottom 106 along the vertical direction V, between a left side 108 and a right side 110 along the lateral direction L, and between a front and a rear along the transverse direction T.

A dryer drum 120 may be received within cabinet 102 and define a drying chamber 126 that is configured for receipt of articles for drying. More specifically, dryer drum 120 may be rotatably mounted within cabinet 102 such that it is rotatable about a rotation axis. Generally, the rotation axis is defined non-parallel to the vertical direction V (e.g., closer to perpendicular than parallel). According to the illustrated embodiments, the rotation axis is substantially parallel to the transverse direction T. In this regard, dryer appliance 100 is generally referred to as a "horizontal-axis" or "front-load" dryer appliance 100.

While described in the context of a specific embodiment of front load dryer appliance 100, using the teachings disclosed herein it will be understood that front load dryer appliance 100 is provided by way of example only. Other combination washing machine or dryer appliances having different configurations, different appearances, or different features may also be utilized with the present subject matter as well.

Dryer drum 120 may define one or more features that extend into drying chamber 126 to assist in tumbling articles disposed within drying chamber 126 during operation of dryer appliance 100. For example, a plurality of baffles may extend from dryer drum 120 into drying chamber 126. In this manner, for example, the baffles may lift articles disposed in dryer drum 120 during rotation of dryer drum 120.

As shown in FIG. 1, cabinet 102 also includes a front panel 130 that defines, at least in part, an opening 132 that permits user access to dryer drum 120. More specifically, dryer appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to dryer drum 120 and a closed position (FIG. 1) prohibiting access to dryer drum 120. Optionally (e.g., in the case of a combination washer/dryer appliance), a lock assembly may be fixed to cabinet 102 to selectively lock or hold a free end of the door 134 to cabinet 102 when door 134 is in the closed position (e.g., during certain operations or wash cycles). For reference, door 134 is removed in FIG. 2 to show other elements of dryer appliance 100.

In some embodiments, a central body 136 of door 134 is provided on a perimeter rim that extends about (e.g., radially about) at least a portion of central body 136. In optional embodiments, central body 136 is provided as a window and permits viewing of dryer drum 120 when door 134 is in the closed position (e.g., during operation of dryer appliance 100). Generally, door 134 defines a footprint on a front portion of cabinet 102 (e.g., in a plane defined by the lateral direction L and the transverse direction T). For instance, when door 134 is in the closed position, central body 136 and the perimeter rim may extend across the footprint and thus cover the area of the front panel 130 within the footprint (e.g., when viewed along the transverse direction T directly in front of dryer appliance 100). The footprint may extend radially outward from opening 132. Thus, the footprint may encompass and define a larger width (e.g., diameter) than opening 132. In some such embodiments, central body 136 extends across and, optionally, within opening 132. The perimeter rim may extend radially outward from opening 132 and define the extrema of the footprint.

Figure 2:
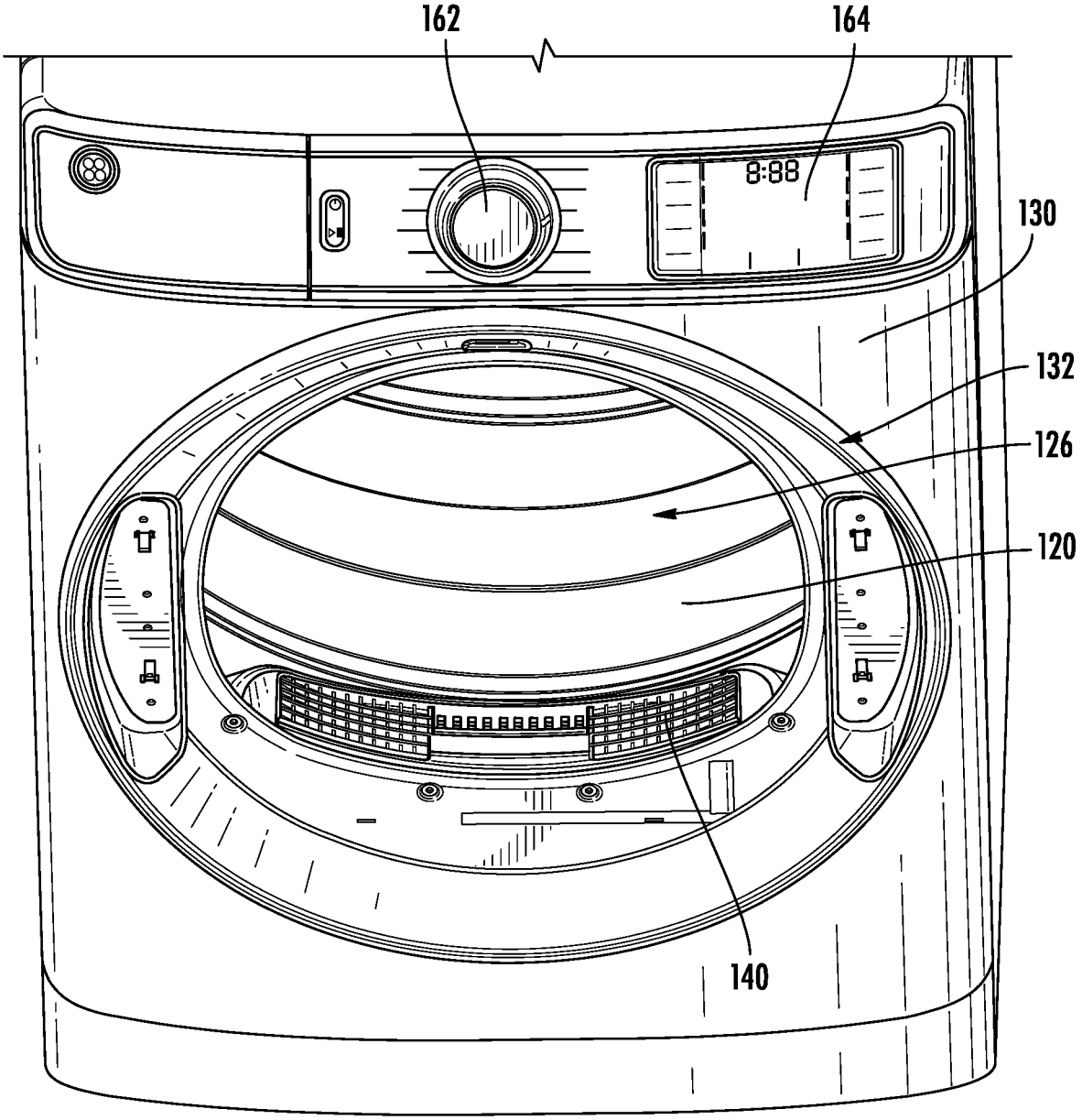
FIG. 2 provides a front perspective view of the exemplary dryer appliance of FIG. 1 with a door removed.

Door 134 may also include a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively (e.g., in the case of a combination washer/dryer), a front gasket or baffle may extend between dryer drum 120 and the front panel 130 about the opening 132 covered by door 134, further sealing dryer drum 120 from cabinet 102. For example, when door 134 is in the closed position, the baffle may contact central body 136 in sealing engagement therewith and within the footprint of door 134. Additionally or alternatively, a lint filter 140 may be provided at opening 132 (e.g., inserted radially into a space between front panel 130 and dryer drum 120, as shown in FIG. 2).

In some embodiments, a control panel 160 including a plurality of input selectors 162 is coupled to front panel 130. Control panel 160 and input selectors 162 may collectively form a user interface input for operator selection of machine cycles and features. For example, in exemplary embodiments, a display 164 indicates selected features, a countdown timer, or other items of interest to machine users.

Operation of dryer appliance 100 is generally controlled by a controller or processing device 166. In some embodiments, controller 166 is in operative communication with (e.g., electrically or wirelessly connected to) control panel 160 for user manipulation to select dryer cycles and features. In response to user manipulation of control panel 160, controller 166 operates the various components of dryer appliance 100 to execute selected machine cycles and features (e.g., as part of a drying operation).

As mentioned above, FIG. 2 is a front view of an exemplary dryer appliance with door 134 removed and showing lint filter 140 in an inserted position. As shown in FIG. 2, lint filter 140 may be inserted into a space between front panel 130 and dryer drum 120. Lint filter 140 may be inserted downward (e.g., in the vertical direction V) radially at or near opening 132. It should be noted that the position of filter 140 in FIG. 2 is merely an example, at a location or position of filter 140 may be adjusted according to specific applications.

Figure 3:
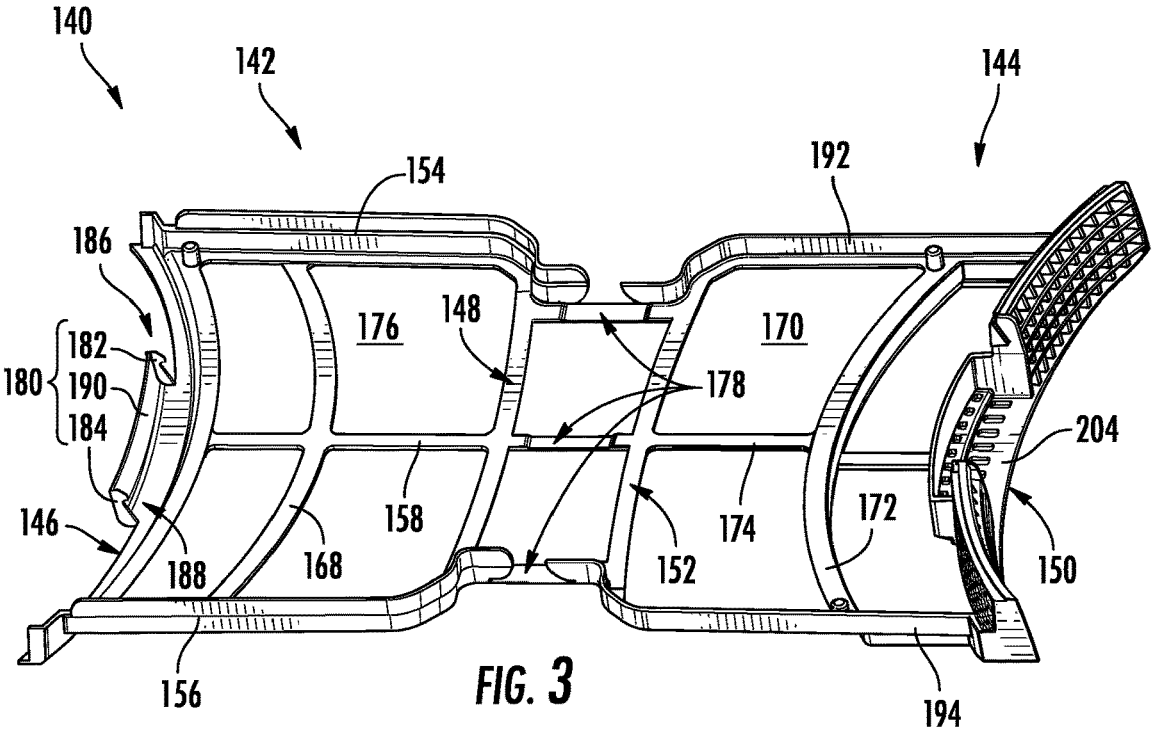
FIG. 3 provides a perspective view of an exemplary lint filter in an open position.
Figure 4:
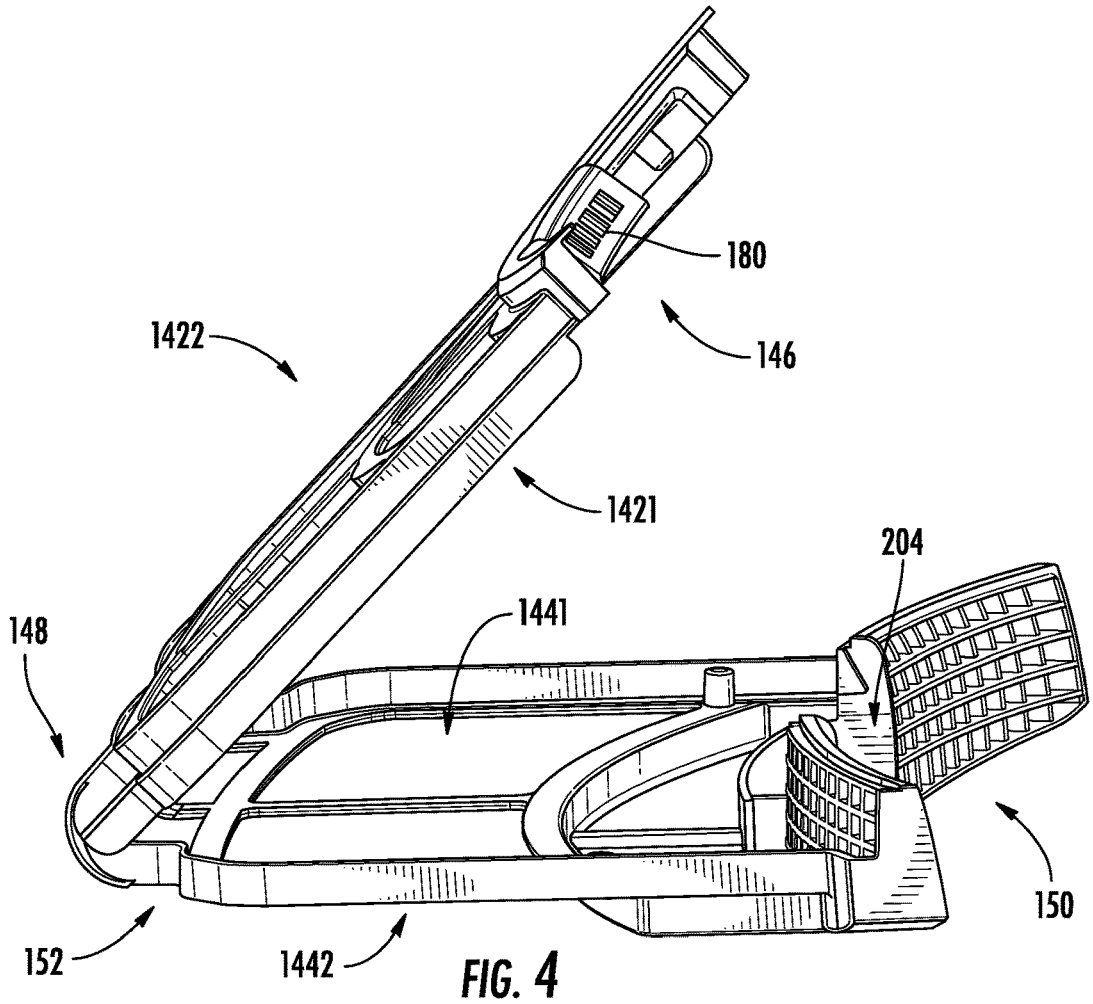
FIG. 4 provides a perspective view of the exemplary lint filter of FIG. 3 in a partially closed position.

FIG. 3 provides a perspective view of an exemplary lint filter according to an embodiment of the present disclosure. As shown in FIG. 3, lint filter 140 may include a clamshell style frame. For instance, the frame may include a first housing 142 and a second housing 144. The first housing 142 and the second housing 144 may be attached to each other via a hinge 178. In detail, first housing 142 may define a free end 146 and a hinged end 148. Further, first housing 142 may define an inner face 1421 and an opposing outer face 1422. Similarly, second housing 144 may define a free end 150 and a hinged end 152. Further, second housing 144 may define an inner face 1441 and an opposing outer face 1442. Free end 146 may be opposite hinged end 148, and free end 150 may be opposite hinged end 152. Hinged end 148 may be pivotally connected to hinged end 152, such that first housing 142 rotated with respect to second housing 144.

Hinged end 148 of first housing 142 may be adjacent to hinged end 152 of second housing 144. Thus, hinge 178 may connect hinged end 148 to hinged end 152. In some embodiments, hinge 178 is a living hinge. In detail, hinge 178 is formed of the same material as first housing 142 and second housing 144. A thickness of hinge 178 may be less than a thickness of first housing 142 and second housing 144. Accordingly, hinge 178 may be malleable to allow first housing 142 to rotate with respect to second housing 144 such that first housing 142 may overlap with second housing 144. Free end 146 of first housing 142 and free end 150 of second housing 144 may mate with each other when the frame is in a closed position (e.g., first housing 142 is pivoted or rotated about hinge 178 such that inner face 1421 of first housing 142 faces inner face 1441 of second housing 144).

First housing 142 may include a framework of struts and side rails. For instance, first housing 142 may include a first side rail 154 and a second side rail 156 opposite the first side rail 154. The first and second side rails 154, 156 may extend between free end 146 and hinged end 148. Additionally or alternatively, first and second slide rails 154, 156 may protrude inward (e.g., away from inner face 1421). In some embodiments, first side rail 154 and second side rail 156 may curve toward each other at hinged end 148. First housing 142 may further include a center strut 158. Center strut 158 may be positioned between first side rail 154 and second side rail 156. For instance, center strut 158 may be equidistant from first side rail 154 and second side rail 156. Additionally or alternatively, center strut 158 may be predominantly parallel with side rails 154 and 156. Center strut 158 may extend between free end 146 and hinged end 148. First housing 142 may include a cross strut 168. Cross strut 168 may extend between first side rail 154 and second side rail 156 (e.g., continuously from first side rail 154 to second side rail 156). Cross strut 168 may intersect with center strut 158. Thus, center strut 158, cross strut 168, first side rail 154, and second side rail 156 may define a plurality of apertures 176 through which air from dryer drum 120 passes.

Free end 146 may be concave toward hinged end 148. For instance, free end 146 may have a predetermined concave curve toward hinged end 148. The predetermined curve may be equal to a curvature of opening 132. Accordingly, free end 146 may fit seamlessly along opening 132. A filter material (e.g., cellulose filtration element, carbon filtration element, wire mesh, etc.) may be provided across each of the apertures 176 to collect lint and foreign debris from the air. Thus, the lint and foreign debris may be removed from the air and the clean air may be recirculated into the dryer drum 120 or exhausted out from the dryer appliance 100.

Second housing 144 may include a framework of struts and side rails. For instance, Second housing 144 may include a first side rail 192 and a second side rail 194 opposite the first side rail 192. The first and second side rails 192, 194 may extend between free end 150 and hinged end 152. Additionally or alternatively, first and second slide rails 192, 194 may protrude inward (e.g., away from front face 1441). In some embodiments, first side rail 192 and second side rail 194 may curve toward each other at hinged end 152. Second housing 144 may further include a center strut 174. Center strut 174 may be positioned between first side rail 192 and second side rail 194 (e.g., continuously from first side rail 192 to second side rail 194). For instance, center strut 174 may be equidistant from first side rail 192 and second side rail 194. Additionally or alternatively, center strut 174 may be predominantly parallel with side rails 192 and 194. Center strut 174 may extend between free end 150 and hinged end 152. Second housing 144 may include a cross strut 172. Cross strut 172 may extend between first side rail 192 and second side rail 194. Cross strut 172 may intersect with center strut 174. Thus, center strut 174, cross strut 172, first side rail 192, and second side rail 194 may define a plurality of apertures 170 through which air from dryer drum 120 passes.

Free end 150 may be concave toward hinged end 152. For instance, free end 150 may have a predetermined concave curve toward hinged end 152. The predetermined curve may be equal to a curvature of opening 132. Additionally or alternatively, the predetermined curvature may be equal to the predetermined curvature of free end 146 of first housing 142. Accordingly, free end 150 may fit seamlessly along opening 132. A filter material (e.g., cellulose filtration element, carbon filtration element, wire mesh, etc.) may be provided across each of the plurality of apertures 170 to collect lint and foreign debris from the air. Thus, the lint and foreign debris may be removed from the air and the clean air may be recirculated into the dryer drum 120 or exhausted out from the dryer appliance 100.

First housing 142 may further include a handle 180 provided at free end 146. Handle 180 may be located at a center of free end 146 (e.g., between first side rail 154 and second side rail 156). Handle 180 may include a first latch 182 and a second latch 184. First latch 182 and second latch 184 may extend inward from front face 1421. First latch 182 may be disposed at a first lateral end 186 of handle 180. Second latch 184 may be disposed at second lateral end 188 of handle 180. First lateral end 186 and second lateral end 188 may be opposite each other. In detail, handle 180 may include a handle body 190 connecting first latch 182 and second latch 184. Handle body 190 may protrude inward from front face 1421. Handle body 190 may be concave toward hinged end 148. Handle body 190 may have a predetermined curvature that is equal to the predetermined curvature of free ends 146 and 150 of first and second housings 142 and 144. Further, handle body 190 may be a continuous flat panel between first latch 182 and second latch 184. Handle body 190 may define a grip surface directed toward hinged end 148 (e.g., on a convex side of the curved flat panel).

Figure 5:
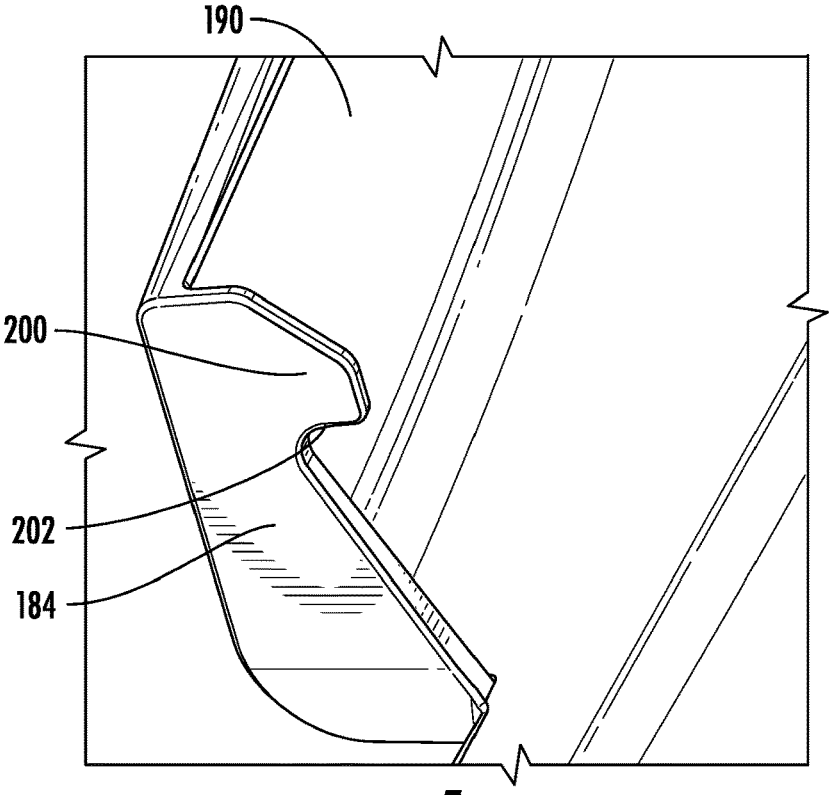
FIG. 5 provides a close-up perspective view of a latch of the exemplary lint filter of FIG. 3.
Figure 8:
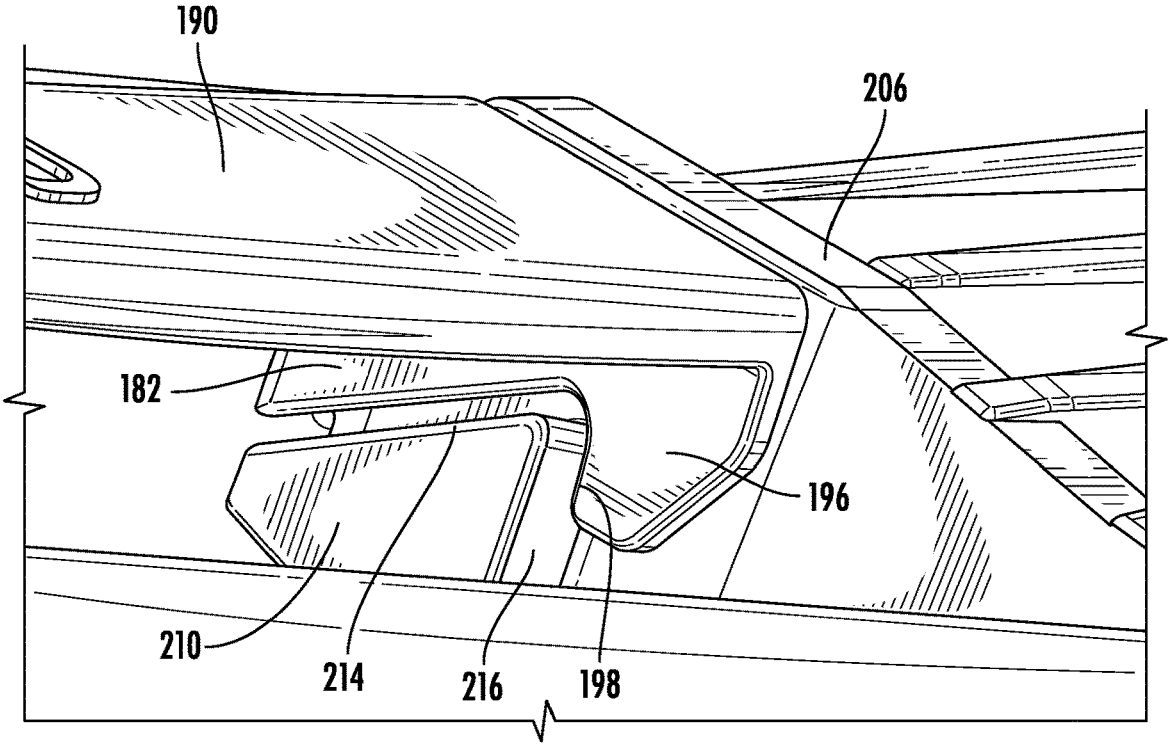
FIG. 8 provides a close-up perspective view of the exemplary lint filter of FIG. 3 in a closed position.

As best shown in FIGS. 3, 5 and 8, first latch 182 may include a first hook tip 196. First hook tip 196 may protrude from a distal end of first latch 182. In some embodiments, first hook tip 196 protrudes toward hinged end 148. First hook tip 196 may define a catch face 198 on an underside thereof. For instance, catch face 198 may be predominantly parallel to inner face 1421 of first housing 142. Thus, catch face 198 may form an acute angle with respect to first latch 182. Second latch 184 may include a second hook tip 200. Second hook tip 200 may protrude from a distal end of second latch 184. In some embodiments, second hook tip 200 protrudes toward hinged end 148. Second hook tip 200 may define a catch face 202 on an underside thereof. For instance, catch face 202 may be predominantly parallel to inner face 1421 of first housing 142. Thus, catch face 202 may form an acute angle with respect to second latch 184.

Figure 6:
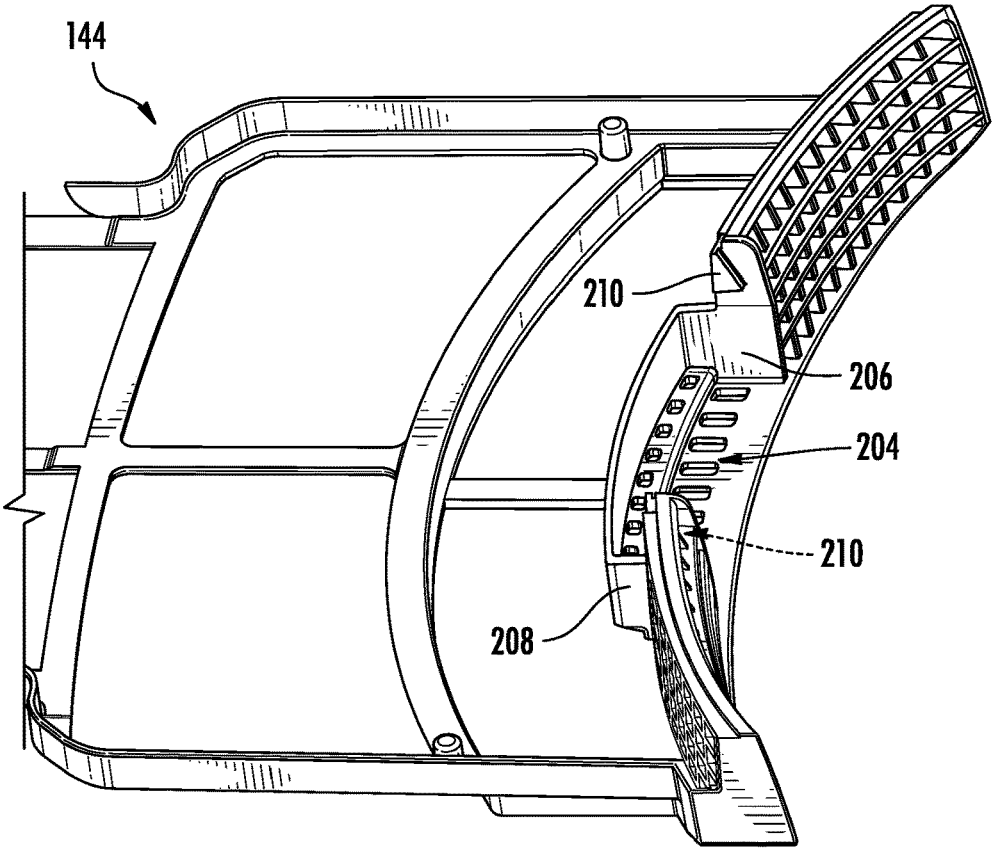
FIG. 6 provides a perspective view of a housing of the exemplary lint filter of FIG. 3.
Figure 7:
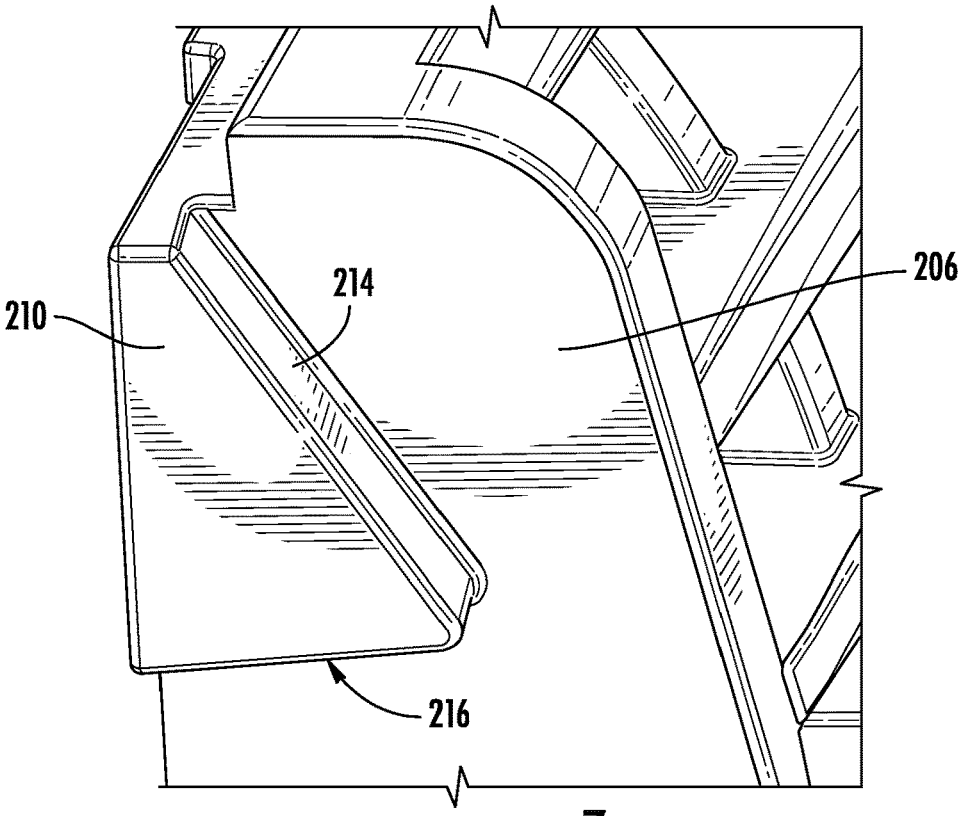
FIG. 7 provides a close-up perspective view of a protrusion of the exemplary lint filter of FIG. 3.

As best shown in FIGS. 6 and 7, second housing may define a handle groove 204. Handle groove 204 may have a lateral interior defined between a first groove end 206 and a second groove end 208. Handle groove 204 may correspond to handle 180 on first housing 142. For instance, when filter 140 is moved to a closed position, handle 180 (including first latch 182 and second latch 184) may be accepted within handle groove 204. A first protrusion 210 may be located within handle groove 204. For instance, first protrusion 210 may be provided at first groove end 206. First protrusion 210 may protrude (e.g., extend) laterally from first groove end 206 toward the lateral interior of handle groove 204. First protrusion 210 may have a predominantly triangular shape. However, the shape of first protrusion 210 is not limited to this, and may have any suitable shape. In some embodiments, first protrusion 210 defines a first ramp face 214 and a first lock face 216. As seen in FIG. 7, first ramp face 214 may protrude toward the lateral interior of handle groove 204. Similarly, first lock face 216 may protrude toward the lateral interior of handle groove 204. First ramp face 214 and first lock face 216 may each be predominantly perpendicular to first groove end 206. Accordingly, first ramp face 214 and first lock face 216 may be referred to as side faces of first protrusion 210.

A second protrusion 210 may be located within handle groove 204. For instance, second protrusion 210 may be provided at second groove end 208. Second protrusion 210 may protrude (e.g., extend) laterally from second groove end 208 toward the lateral interior of handle groove 204. Second protrusion 210 may have a predominantly triangular shape. However, the shape of second protrusion 210 is not limited to this and may have any suitable shape. In some embodiments, second protrusion 210 defines a second ramp face 214 and a second lock face 216. Similar to first protrusion 210, second ramp face 214 may protrude toward the lateral interior of handle groove 204. Similarly, second lock face 216 may protrude toward the lateral interior of handle groove 204. Second ramp face 214 and second lock face 216 may each be predominantly perpendicular to second groove end 208. Accordingly, second ramp face 214 and second lock face 216 may be referred to as side faces of second protrusion 210. As would be understood in light of the present disclosure, second protrusion 210 may be identical to first protrusion 210 and mirrored laterally about handle groove 204.

First protrusion 210 may correspond to first latch 182, and second protrusion 210 may correspond to second latch 184. When lint filter 140 is in the closed position, first latch 182 may be latched to first protrusion 210 (e.g., as shown in FIG. 8), and second latch 184 may be latched to second protrusion 210. In detail, the handle (including first latch 182 and second latch 184) may be inserted into handle groove 204. During insertion, first latch 182 may pass over first protrusion 210 and second latch 184 may pass over second protrusion 210. First hook tip 196 may contact first ramp face 214 of first protrusion 210 and snap over first protrusion 210 at the junction of first ramp face 214 and first lock face 216. Accordingly, first catch face 198 of first latch 182 may rest on first lock face 216 of first protrusion 210 and prevent handle 180 from rotating away from and out of handle groove 204. Similarly, second hook tip 200 may contact second ramp face 214 of second protrusion 210 and snap over second protrusion 210 at the junction of second ramp face 214 and second lock face 216. Accordingly, second catch face 202 of second latch 184 may rest on second lock face 216 of second protrusion 210 and prevent handle 180 from rotating away from and out of handle groove 204.

First housing 142, second housing 144, and hinge 178 may be made from a plastic (e.g., polyvinyl chloride [PVC], polyethylene terephthalate [PETE], polypropylene, polystyrene, etc.). As mentioned above, a thickness of first and second housings 142, 144 may be greater than a thickness of hinge 178 (e.g., making hinge 178 a living hinge). However, first and second housings 142, 144 may also be malleable. For instance, when a user pulls on handle body 190 of handle 180, each of first latch 182 and second latch 184 may flex to allow first hook tip 196 to pass over the junction between first ramp face 214 and first lock face 216 and second hook tip 200 to pass over the junction between second ramp face 214 and second lock face 216. Accordingly, by pulling on handle body in a direction away from hinge 178, the lint filter 140 may be opened for cleaning (i.e., first housing 142 may be separated from second housing 144 to rotate via hinge 178. Advantageously, by having two latches mirrored about the handle body, a more robust latching may be realized, reducing part failure and unnecessary repairs.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A lint filter for a laundry treatment apparatus, the lint filter comprising:

a first housing defining an inner face and an opposite outer face, the inner and outer faces of the first housing extending between a hinged end and a free end, the first housing comprising a handle defining a first latch and a second latch each extending inward from the inner face, the first latch being disposed at a first lateral end of the handle, the second latch being disposed at a second lateral end of the handle;

a second housing defining an inner face and an opposite outer face, the inner and outer faces of the second housing extending between a hinged end and a free end, the hinged end of the second housing being pivotally connected to the hinged end of the first housing, the second housing defining a handle groove having a lateral interior defined between a first groove end and a second groove end;

a first protrusion disposed within the handle groove, the first protrusion extending laterally from the first groove end toward the lateral interior of the handle groove; and a second protrusion provided within the handle groove, the second protrusion extending laterally from the second groove end toward the lateral interior of the handle groove.

2. The lint filter of claim 1, wherein the first latch comprises a first hook tip and the second latch comprises a second hook tip, each of the first hook tip and the second hook tip protruding toward the hinged end of the first housing.

3. The lint filter of claim 2, wherein the handle further comprises a handle body connecting the first latch and the second latch, the handle body protruding inward from the inner face of the first housing.

4. The lint filter of claim 2, wherein the first protrusion comprises a first ramp face protruding toward the lateral interior of the handle groove and a first lock face protruding toward the lateral interior of the handle groove, the first ramp face extending at a predetermined acute angle with respect to the first lock face.

5. The lint filter of claim 4, wherein the second protrusion comprises a second ramp face protruding toward the lateral interior of the handle groove and a second lock face protruding toward the lateral interior of the handle groove, the second ramp face extending at a predetermined acute angle with respect to the second lock face.

6. The lint filter of claim 5, wherein a width of the first ramp face and first lock face in the lateral direction is greater than a width of the first latch in the lateral direction, and a width of the second ramp face and second lock face in the lateral direction is greater than a width of the second latch in the lateral direction.

7. The lint filter of claim 6, wherein the lint filter is a clamshell such that the first and second latches of the first housing are connectable to the first and second protrusions of the second housing.

8. The lint filter of claim 7, wherein the first hook tip of the first latch contacts the first lock face of the first protrusion, and the second hook tip of the second latch contacts the second lock face of the second protrusion when the lint filter is in a closed position.

9. The lint filter of claim 1, further comprising a hinge extending between the first housing and the second housing, wherein the hinge is a living hinge connecting the first and second housings and formed of a same material as the first and second housings.

10. A lint filter for a laundry treatment apparatus, the lint filter comprising:

a first housing defining an inner face and an opposite outer face, the inner and outer faces of the first housing extending between a hinged end and a free end, the first housing comprising a first center strut extending between the hinged end and the free end, a first cross strut intersecting with the first center strut and extending between a first side and a second side of the first housing, and a handle defining a first latch and a second latch each extending inward from the inner face, the first latch being disposed at a first lateral end of the handle, the second latch being disposed at a second lateral end of the handle;

a second housing defining an inner face and an opposite outer face, the inner and outer faces of the second housing extending between a hinged end and a free end, the hinged end of the second housing being pivotally connected to the hinged end of the first housing, the second housing defining a handle groove having a lateral interior defined between a first groove end and a second groove end, the second housing comprising a second center strut extending between the hinged end and the free end, and a second cross strut intersecting with the second center strut and extending between a first side and a second side of the second housing;

a first protrusion disposed within the handle groove, the first protrusion extending laterally from the first groove end toward the lateral interior of the handle groove; and a second protrusion provided within the handle groove, the second protrusion extending laterally from the second groove end toward the lateral interior of the handle groove.

11. The lint filter of claim 10, wherein the first latch comprises a first hook tip and the second latch comprises a second hook tip, each of the first hook tip and the second hook tip protruding toward the hinged end of the first housing.

12. The lint filter of claim 11, wherein the handle further comprises a handle body connecting the first latch and the second latch, the handle body protruding inward from the inner face of the first housing.

13. The lint filter of claim 11, wherein the first protrusion comprises a first ramp face protruding toward the lateral interior of the handle groove and a first lock face protruding toward the lateral interior of the handle groove, the first ramp face extending at a predetermined acute angle with respect to the first lock face.

14. The lint filter of claim 13, wherein the second protrusion comprises a second ramp face protruding toward the lateral interior of the handle groove and a second lock face protruding toward the lateral interior of the handle groove, the second ramp face extending at a predetermined acute angle with respect to the second lock face.

15. The lint filter of claim 14, wherein a width of the first ramp face and first lock face in the lateral direction is greater than a width of the first latch in the lateral direction, and a width of the second ramp face and second lock face in the lateral direction is greater than a width of the second latch in the lateral direction.

16. The lint filter of claim 15, wherein the lint filter is a clamshell such that the first and second latches of the first housing are connectable to the first and second protrusions of the second housing.

17. The lint filter of claim 16, wherein the first hook tip of the first latch contacts the first lock face of the first protrusion, and the second hook tip of the second latch contacts the second lock face of the second protrusion when the lint filter is in a closed position.

18. The lint filter of claim 10, further comprising a hinge extending between the first housing and the second housing, wherein the hinge is a living hinge connecting the first and second housings and formed of a same material as the first and second housings.

* * * * *